US007621755B2

(12) United States Patent
Kubo et al.

(10) Patent No.: US 7,621,755 B2
(45) Date of Patent: Nov. 24, 2009

(54) CONTACT AND IC SOCKET USING THE CONTACT

(75) Inventors: Masaaki Kubo, Tokyo (JP); Yoshiharu Ishii, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 11/808,672

(22) Filed: Jun. 12, 2007

(65) Prior Publication Data

US 2007/0287315 A1 Dec. 13, 2007

(30) Foreign Application Priority Data

Jun. 12, 2006 (JP) ..... 2006-162427
May 24, 2007 (JP) ..... 2007-138168

(51) Int. Cl.
*H01R 12/00* (2006.01)

(52) U.S. Cl. ..... 439/66; 439/71

(58) Field of Classification Search ..... 439/66, 439/71

See application file for complete search history.

(56) References Cited

U.S. PATENT DOCUMENTS 4,647,124 A 3/1987 Kandybowski
4,906,194 A 3/1990 Grabbe
4,927,369 A 5/1990 Grabbe et al.
4,941,832 A 7/1990 Korsunsky et al.
4,969,826 A 11/1990 Grabbe
5,139,427 A 8/1992 Boyd et al.
5,152,695 A 10/1992 Grabbe et al.
5,342,205 A 8/1994 Hashiguchi
5,820,389 A 10/1998 Hashiguchi
6,022,248 A * 2/2000 Wu et al. ..... 439/862
6,227,869 B1 * 5/2001 Lin et al. ..... 439/66
6,638,078 B2 10/2003 Hashiguchi et al.
6,749,440 B1 6/2004 Szu et al.
6,893,269 B2 5/2005 Matsunaga
6,921,270 B2 7/2005 Mendenhall et al.
6,945,788 B2 9/2005 Trout et al.
6,948,942 B1 9/2005 Chih
6,976,888 B2 12/2005 Shirai et al.
7,052,284 B2 * 5/2006 Liao et al. ..... 439/66

(Continued)

FOREIGN PATENT DOCUMENTS

JP 2-247995 10/1990

(Continued)

*Primary Examiner*—Truc T Nguyen
(74) *Attorney, Agent, or Firm*—Finnegan, Henderson, Farabow, Garrett & Dunner, LLP

(57) ABSTRACT

A contact includes a support member, a first spring portion, a second spring portion, a third spring portion and a fourth spring portion. The first spring portion extends obliquely upper forwardly from an upper end of the support member and has, at an apex, a first contact point which contacts with an IC package. The second spring portion is bent from the first contact point, to extend obliquely lower rearwardly and have a first touch portion. The third spring portion extends obliquely lower forwardly from a lower end of the support member and has a second contact point which contacts with a printed-wiring board, thus being in contrast with the first spring portion with respect to the support member. The fourth spring portion is bent from the second contact point, to extend obliquely upper rearwardly and has a second touch portion for contacting with the first touch portion.

19 Claims, 17 Drawing Sheets

U.S. PATENT DOCUMENTS

| | | | | |
|---|---|---|---|---|
| 7,094,066 | B2 | 8/2006 | Mendenhall et al. | |
| 7,134,880 | B2 * | 11/2006 | Arai et al. | 439/66 |
| 7,160,115 | B2 * | 1/2007 | Huang et al. | 439/66 |
| 2004/0067665 | A1 | 4/2004 | Nakano | |
| 2004/0253844 | A1 | 12/2004 | Mendenhall et al. | |
| 2005/0118888 | A1 | 6/2005 | Mendenhall et al. | |
| 2005/0118890 | A1 | 6/2005 | Mendenhall et al. | |
| 2005/0124183 | A1 | 6/2005 | Hou | |
| 2005/0153604 | A1 | 7/2005 | Mendenhall et al. | |
| 2005/0174746 | A1 | 8/2005 | Hsiao et al. | |
| 2005/0239303 | A1 | 10/2005 | Lee et al. | |
| 2007/0066091 | A1 | 3/2007 | Mendenhall et al. | |

FOREIGN PATENT DOCUMENTS

| | | |
|---|---|---|
| JP | 2-295082 | 12/1990 |
| JP | 4-101388 | 9/1992 |
| JP | 05-017946 | 3/1993 |
| JP | 8-222335 | 8/1996 |
| JP | 9-073960 | 3/1997 |
| JP | 10-125428 | 5/1998 |
| JP | 11-102761 | 4/1999 |
| JP | 2912882 | 4/1999 |
| JP | 3078529 | 4/2001 |
| JP | 2002-050421 | 2/2002 |
| JP | 2002-093542 | 3/2002 |
| JP | 2002-134192 | 5/2002 |
| JP | 2002-184489 | 6/2002 |
| JP | 2002-313459 | 10/2002 |
| JP | 2002-367746 | 12/2002 |
| JP | 2003-017170 | 1/2003 |
| JP | 2003-017171 | 1/2003 |
| JP | 2003-017172 | 1/2003 |
| JP | 2004-158430 | 6/2004 |
| JP | 2004-207165 | 7/2004 |
| JP | 2005-174839 | 6/2005 |
| JP | 2005-216608 | 8/2005 |
| JP | 2005-222924 | 8/2005 |
| JP | 2006-86109 | 3/2006 |
| JP | 2007-503103 | 2/2007 |
| JP | 2007-103311 | 4/2007 |

* cited by examiner

CONTACT AND IC SOCKET USING THE CONTACT

This application claims the benefit of Japanese Patent Application Nos. 2006-162427 filed Jun. 12, 2006, 2007-138168 filed May 24, 2007 which are hereby incorporated by reference herein in their entirety.

BACKGROUND OF THE INVENTION

1. Field of the Invention

The present invention relates to a contact and an IC socket using the contact, and more particularly to a contact having two objects to contact, placed above and below thereof, and to an IC socket using such the contact.

2. Description of the Related Art

It is a conventional practice to use a contact having two objects-to-contact above and below thereof (e.g. an IC package placed above and a printed-wiring board placed below) as disclosed in Japanese Patent Laid-Open No.H10-125428 and Japanese Utility Model Registration No. 3,078,529, as contact for an IC socket to mount and test an integrated circuit package (referred to as an "IC package", from now on) compatible with high frequency. Those contacts are each structured to be placed in elastic contact with both of an IC package mounted on the IC socket and a printed-wiring board such as a test board so that electrical connection is obtained with both the IC package and the printed-wiring board. Meanwhile, those contacts are devised to shorten the signal path length of a current (signal) flowing through the contact and reduce the inductance thereof, in order to cope with high-frequency signals.

The contact, having such two objects-to-contact, requires an increased spring constant in order to stably keep the electrical contact with the IC package and the printed-wiring board. In order to increase the contact spring constant (i.e. increasing the contact springiness), the contact must be increased in length at the elastically deforming portion thereof. This however increases the size of the contact and hence the signal path length along which the signal passes through the contact. Due to this, there encounters the increasing inductance over the signal path formed through the contact, resulting in a fear that the signal is not to be exchanged correctly between the printed-wiring board and the IC package due to the occurrence of noises, etc. Thus, the contact is difficult to design because of the contradictory in increasing the contact springiness and making the contact compatible with higher frequency.

Moreover, the IC package recently has an increased number of external contacts. As the pitch of external contact decreases, the contact itself is required smaller in size. There is a difficulty in obtaining a contact having a high springiness to keep the contact pressure between the contact and the object-to-contact at predetermined pressure.

Meanwhile, because of having two objects-to-contact, the contact is required to provide stable electrical connection for both of the objects. This requires the accuracy in arranging the contact and hence the significant time in the manufacture.

Both the existing contacts are not easy to reduce the size in obtaining higher springiness. Meanwhile, the contact disclosed in Japanese Patent Laid-Open No.H10-125428 is not easy to fit in a spring-receiving chamber of the socket body. The contact disclosed in Japanese Utility Model Registration No. 3,078,529 requires fitting accuracy and arranging solder bumps. In each of the arts, time is needed significant in the manufacture.

In view of the foregoing problems, it is an object of the present invention to provide a contact having two objects-to-contact above and below thereof which is easy to reduce the size and capable of obtaining high springiness and contacting electrically with both two objects-to-contact with stability and is easy to fit in an IC socket, as well as an IC socket using the contact.

SUMMARY OF THE INVENTION

In accordance with the present invention, a contact comprises a support member, a first spring portion, a second spring portion, a third spring portion and a fourth spring portion. The support member is in a plate form broad in width extending vertically. The first spring portion extends obliquely upper forwardly from an upper end of the support member and has, at an apex, a first contact point where to contact with an integrated circuit package. The second spring portion is bent from the first contact point of the first spring portion, to extend obliquely lower rearwardly and have a first touch portion at a tip thereof. The third spring portion extends obliquely lower forwardly from a lower end of the support member and having, at an apex thereof, a second contact point where to contact with a printed-wiring board, thus being located on opposite side of the first spring portion with respect to the support member. The fourth spring portion is bent from the second contact point of the third spring portion, to extend obliquely upper rearwardly and have, at a tip, a second touch portion for abutment against the first touch portion.

In accordance with the invention, an IC socket comprises a socket body, a plurality of contacts and a press member. The socket body has an IC-package mounting recess and a plurality of contact-receiving chambers formed in a bottom of the IC-package mounting recess correspondingly to external contacts of an IC package. The contact according to the invention is employed for a plurality of contacts, and received in each of the plurality of contact-receiving chambers. A press member is to push an IC package, placed in the IC-package mounting recess, onto contacts received in the contact-receiving chambers.

Meanwhile, in the IC socket of the invention, an engagement claw, for preventing removal, is preferably formed rising obliquely rearwardly in the support member. Meanwhile, the contact-receiving chamber is preferably formed through the socket body, to have fitting grooves where both sides of the support member broad in width are fit, and an engagement groove to receive the engagement claw of the contact. More preferably, the fitting groove is formed with a first restriction wall while the engagement groove is formed with a second restriction wall, wherein the first and second restriction walls have a distance greater than that of between an upper end of the engagement claw and a lower end of the support member of the contact.

With the above structure, the contact of the invention is to have a high springiness with which electric contact is available at desired pressure with an object-to-contact despite simple in structure. Accordingly, the contact of the invention is to be stably placed in electrical contact with two objects-to-contact put above and below thereof. Meanwhile, the contact of the invention is to be easily attached in an IC socket. Furthermore, the contact of the invention is compatible with high frequency, to fully reduce a signal line without spoiling its high springiness.

Furthermore, in the IC socket of the invention, by merely providing the contact-receiving chamber with fitting grooves where the support member of the contact is fit and an engagement groove where an engagement claw is fit, contacts can be easily attached in the IC socket. Meanwhile, in the IC socket of the invention, the contact is allowed to fully exhibit its springiness by forming the contact vertically movable within the contact-receiving chamber.

Further features of the present invention will become apparent from the following description of exemplary embodiments with reference to the attached drawings.

DESCRIPTION OF THE EMBODIMENT

Using FIGS. 1 to 17, explanation will be made on embodiments according to the present invention.

Figure 1:
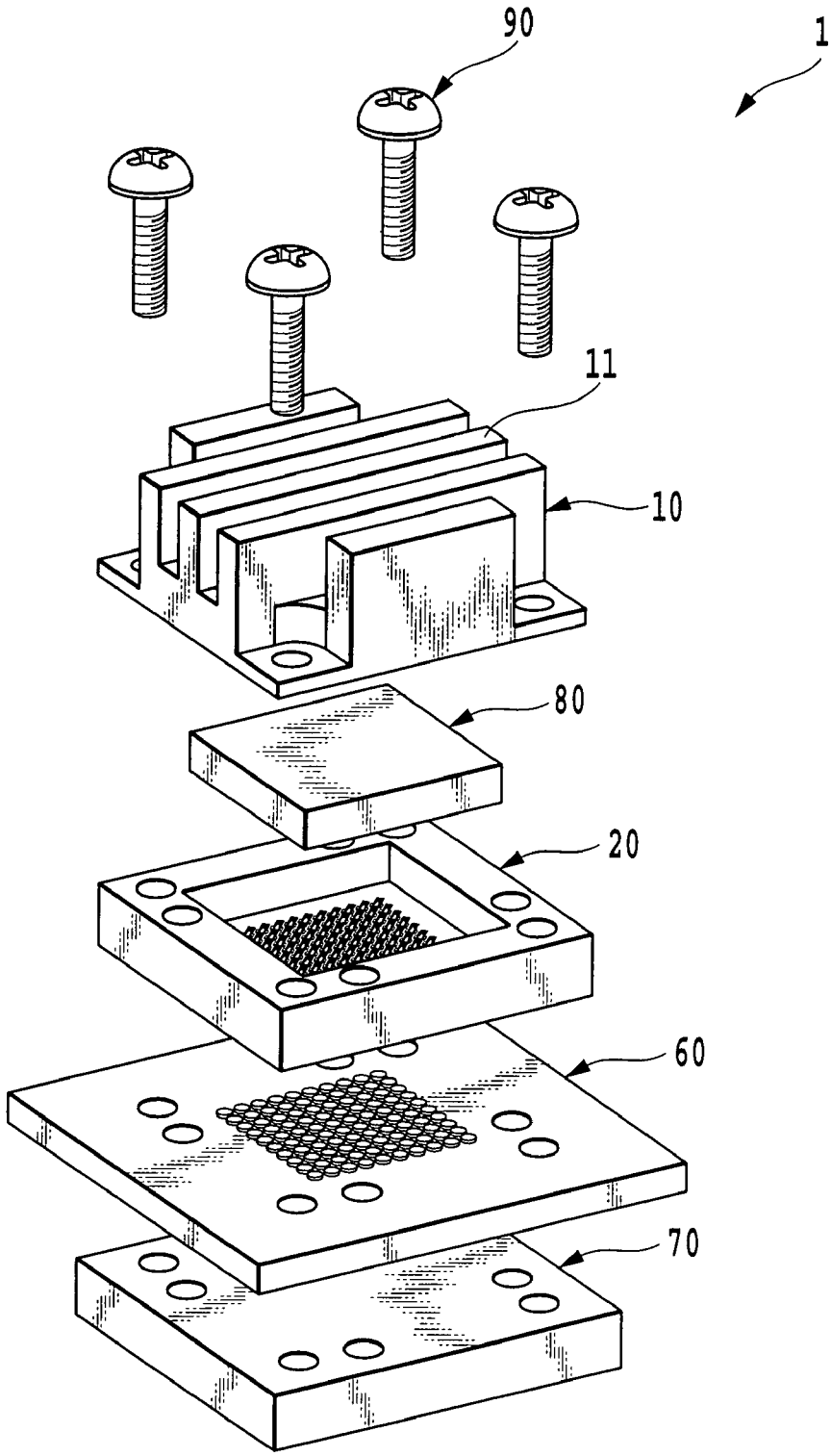
FIG. 1 is a schematic exploded perspective view of an IC socket using contacts having two objects-to-contact, according to the present invention.
Figure 2:
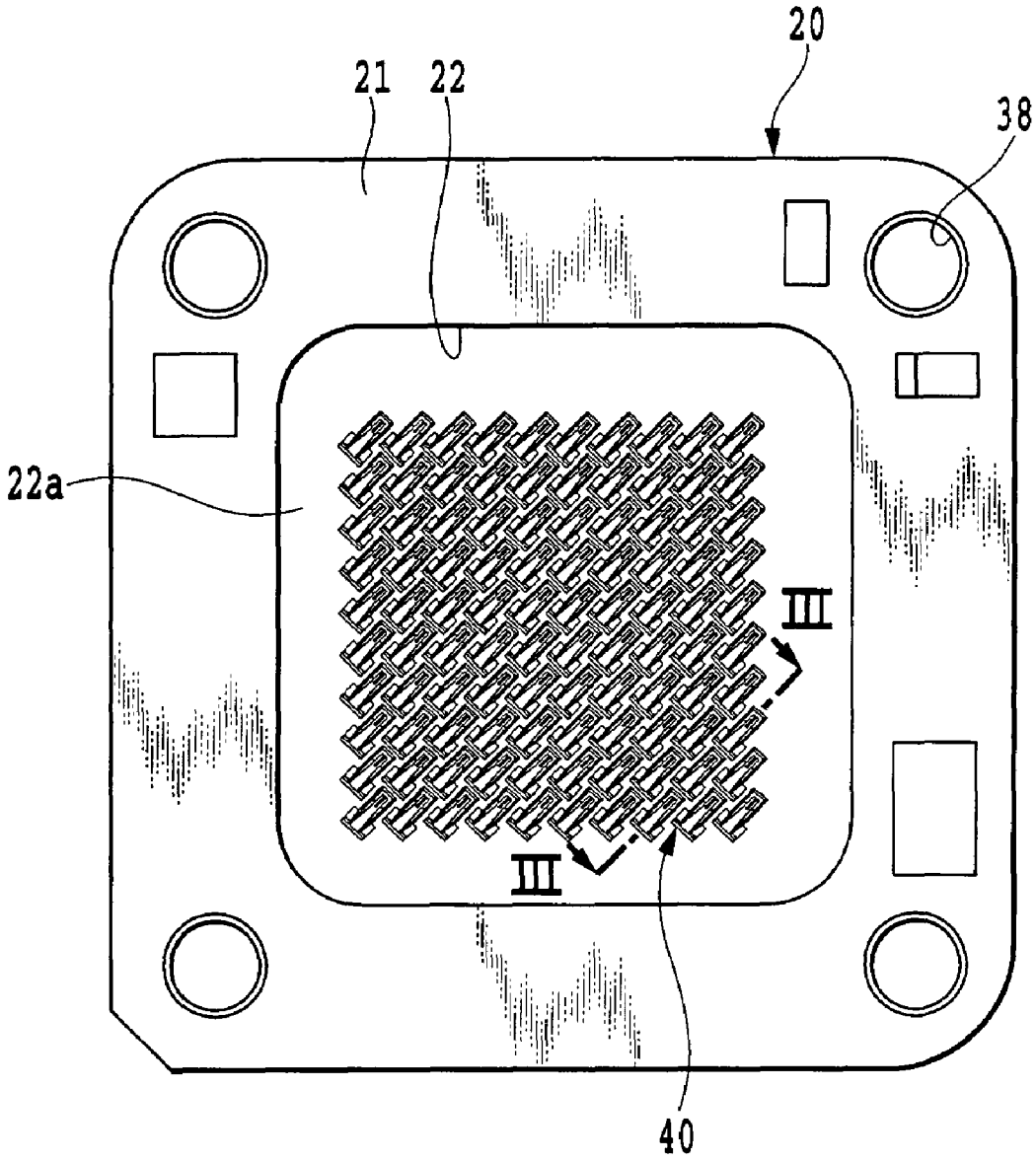
FIG. 2 is a top view of a socket body of IC socket shown in FIG. 1.
Figure 3:
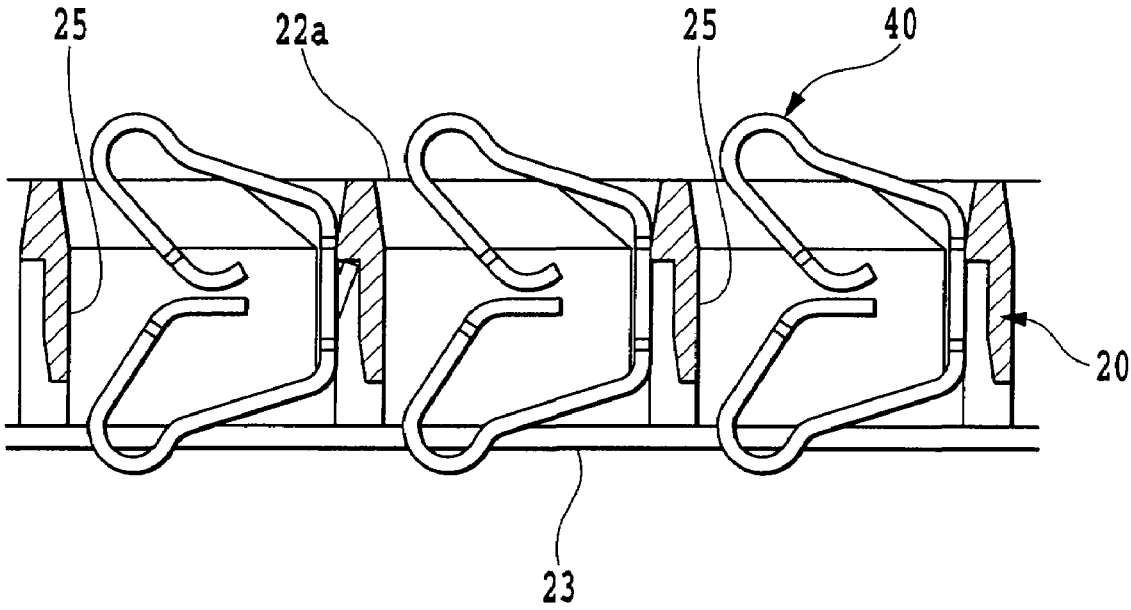
FIG. 3 is a schematic essential-part magnified sectional view taken along line III-III in FIG. 2.
Figure 4:
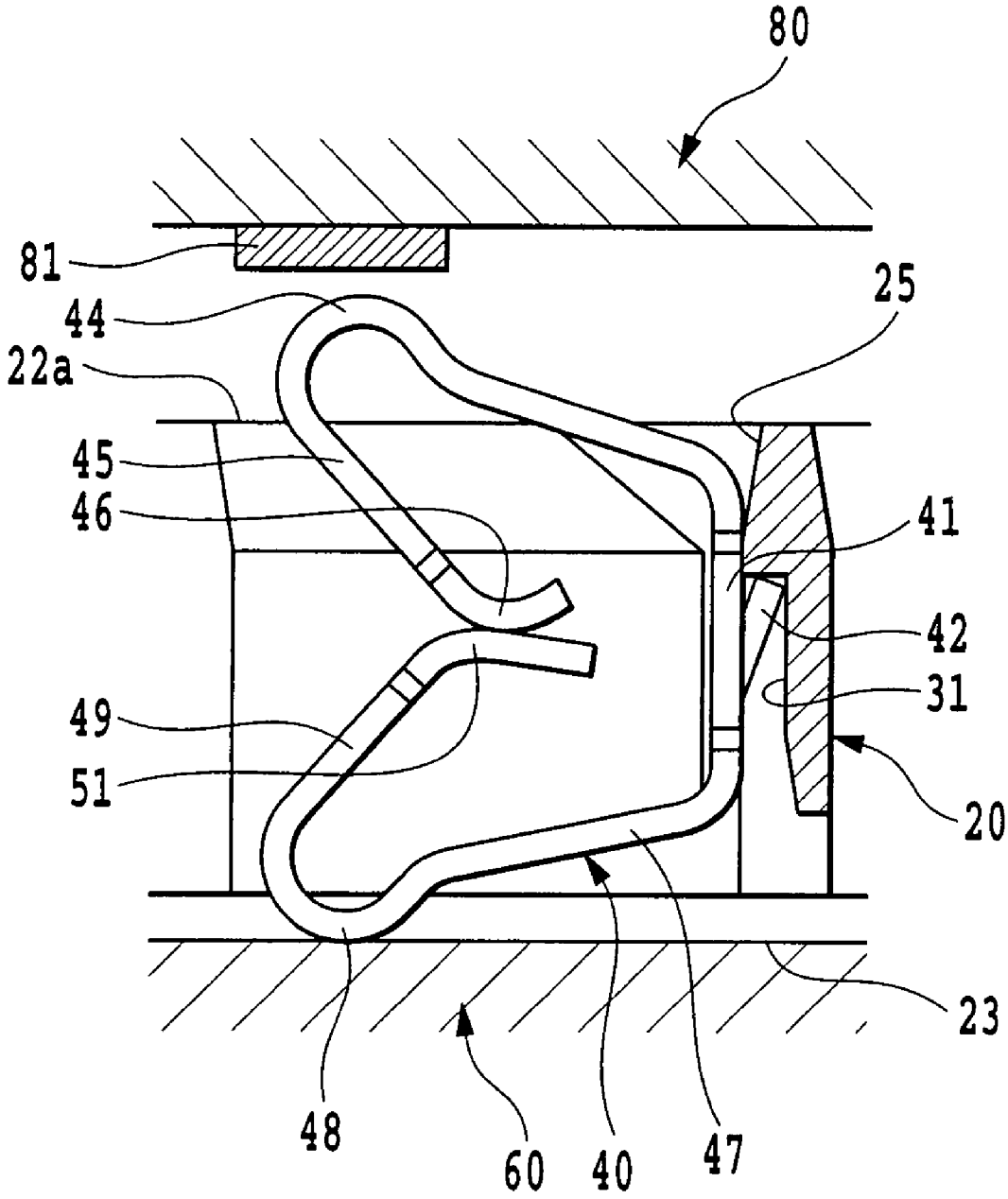
FIG. 4 is an essential-part magnified sectional view showing the state of contacts before mounting an IC package on the IC socket.
Figure 5:
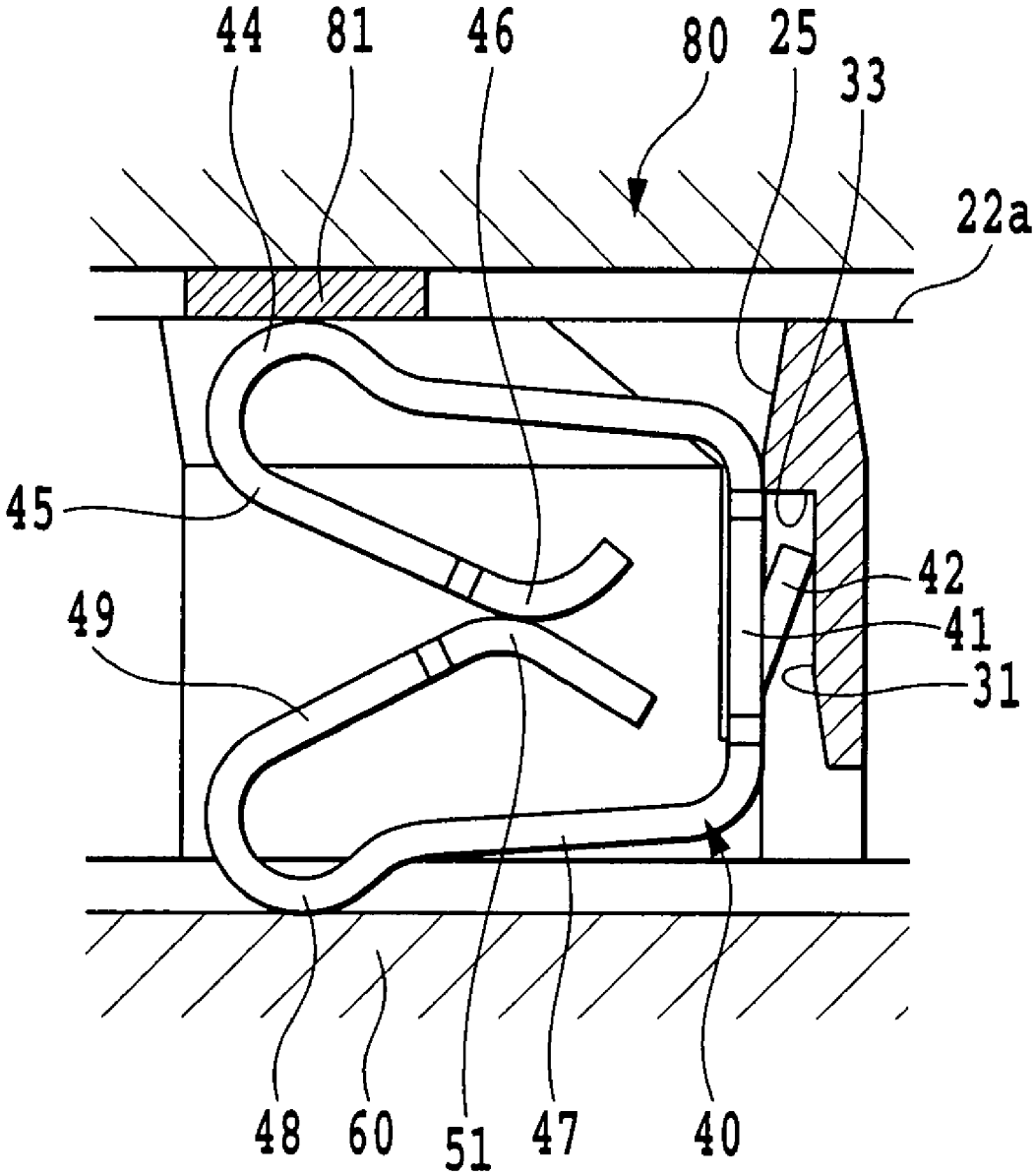
FIG. 5 is an essential-part magnified sectional view showing the state of the contact where an IC package is mounted on the IC socket.
Figure 6:
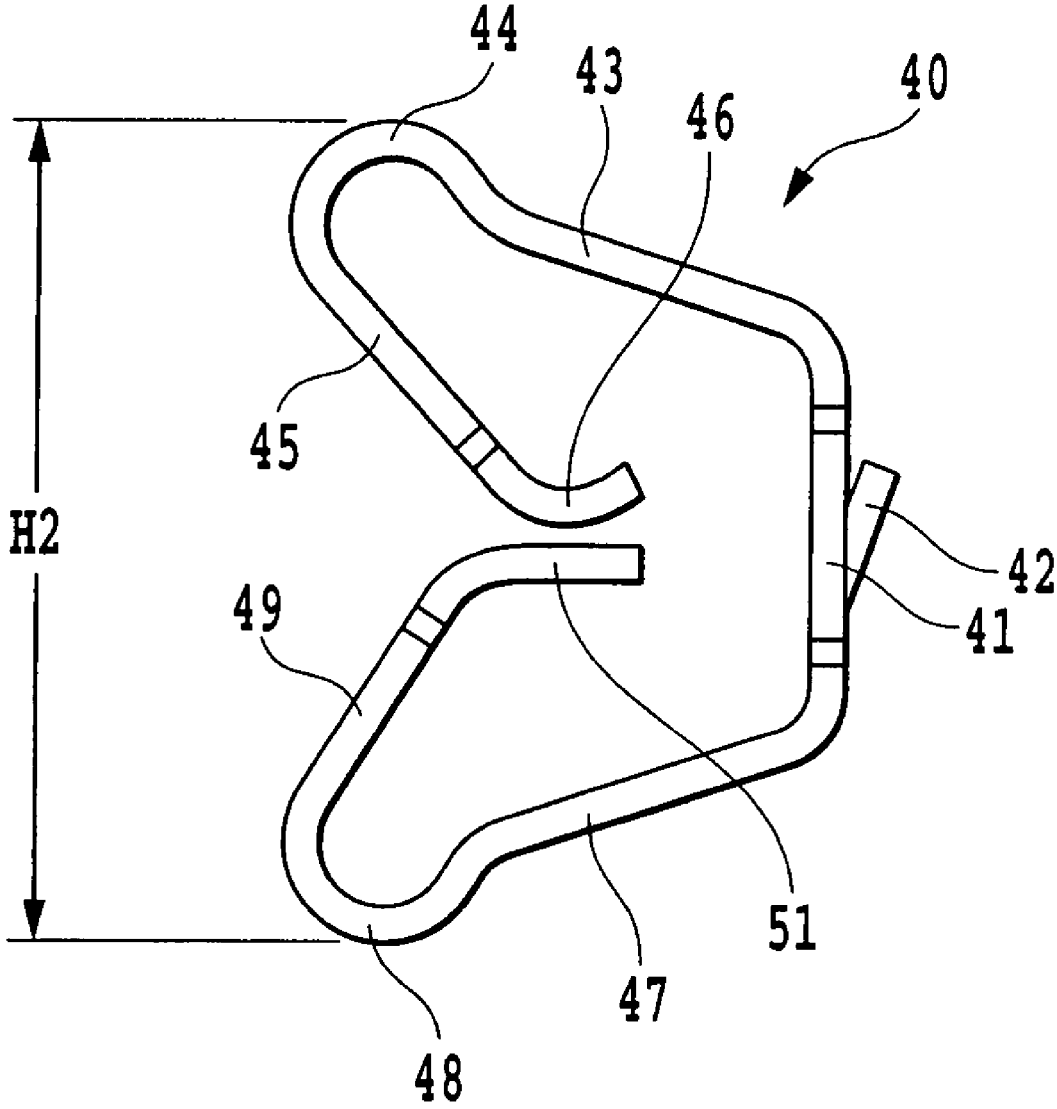
FIG. 6 is a front view of a contact according to the invention.
Figure 7:
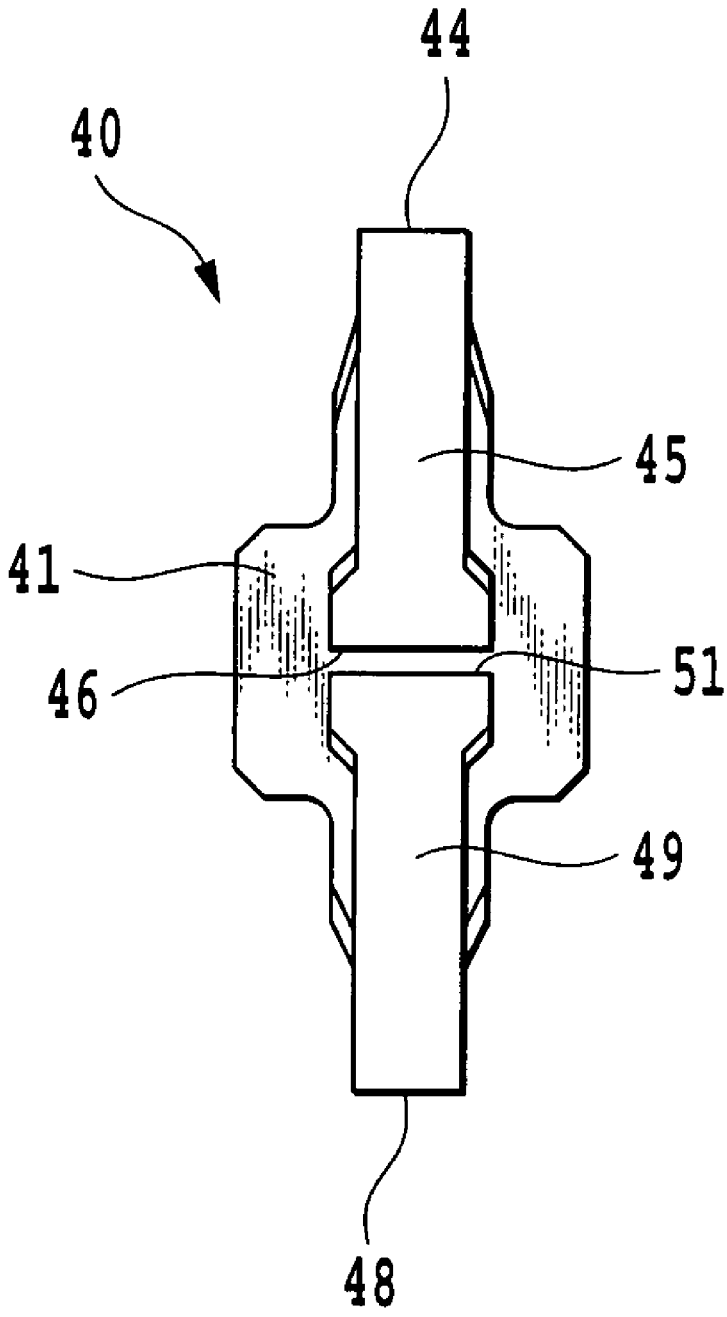
FIG. 7 is a left-side view of the FIG. 6 contact.
Figure 8:
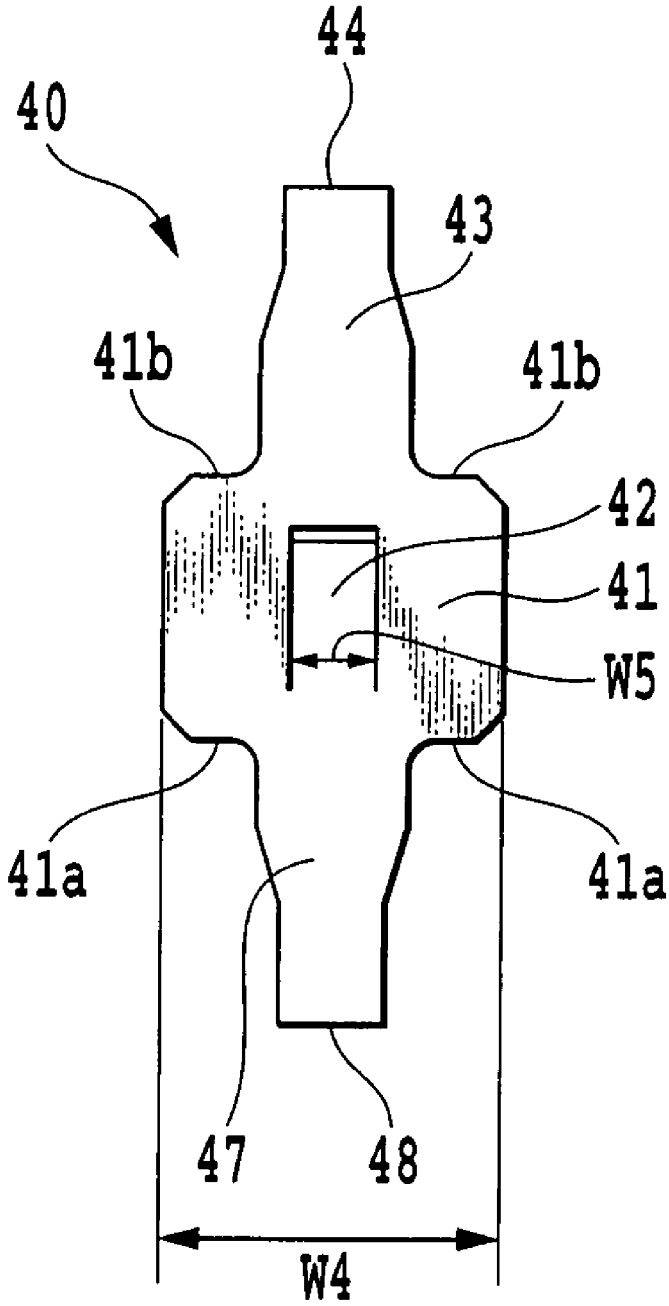
FIG. 8 is a right-side view of the FIG. 6 contact.
Figure 9:
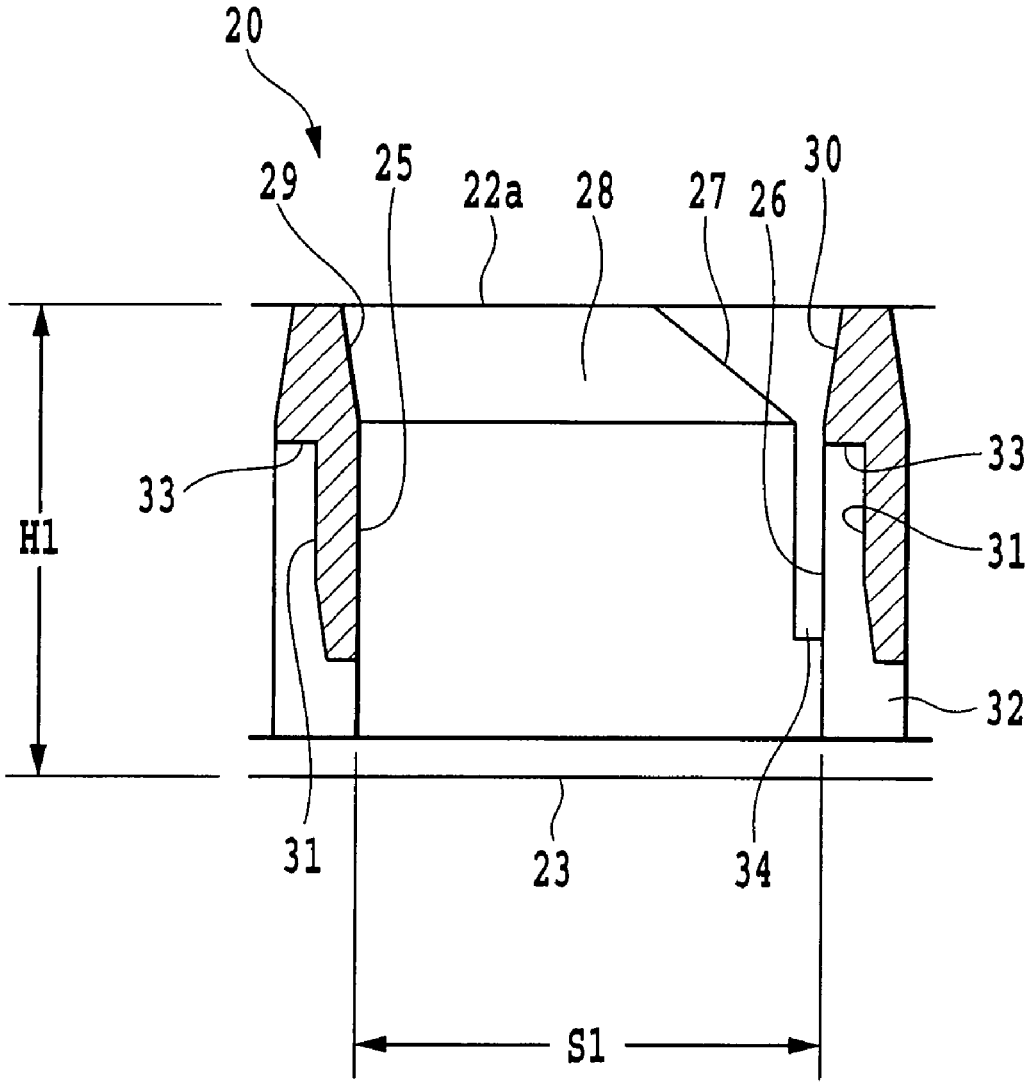
FIG. 9 is a schematic essential-part sectional view of a contact-receiving chamber of a socket body for receiving the contact.
Figure 10A:
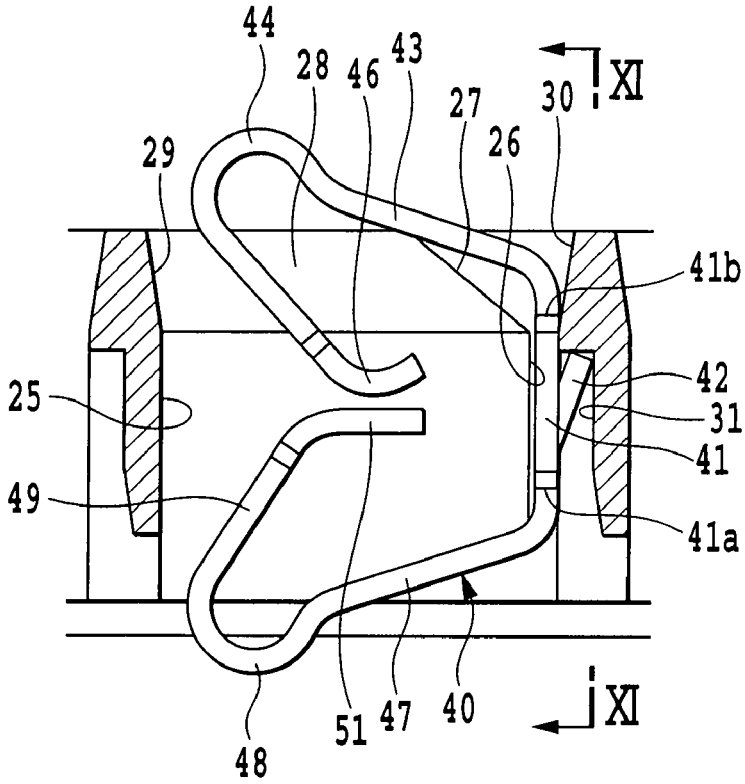
FIG. 10A is a schematic essential-part sectional view showing a contact fit in the contact-receiving chamber shown in FIG. 9.
Figure 10B:
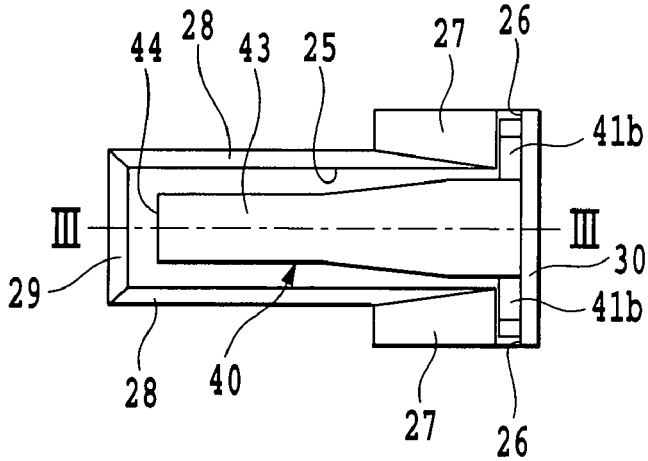
FIG. 10B is a schematic top view of the contact fit in the contact-receiving chamber shown in FIG. 9.
Figure 11:
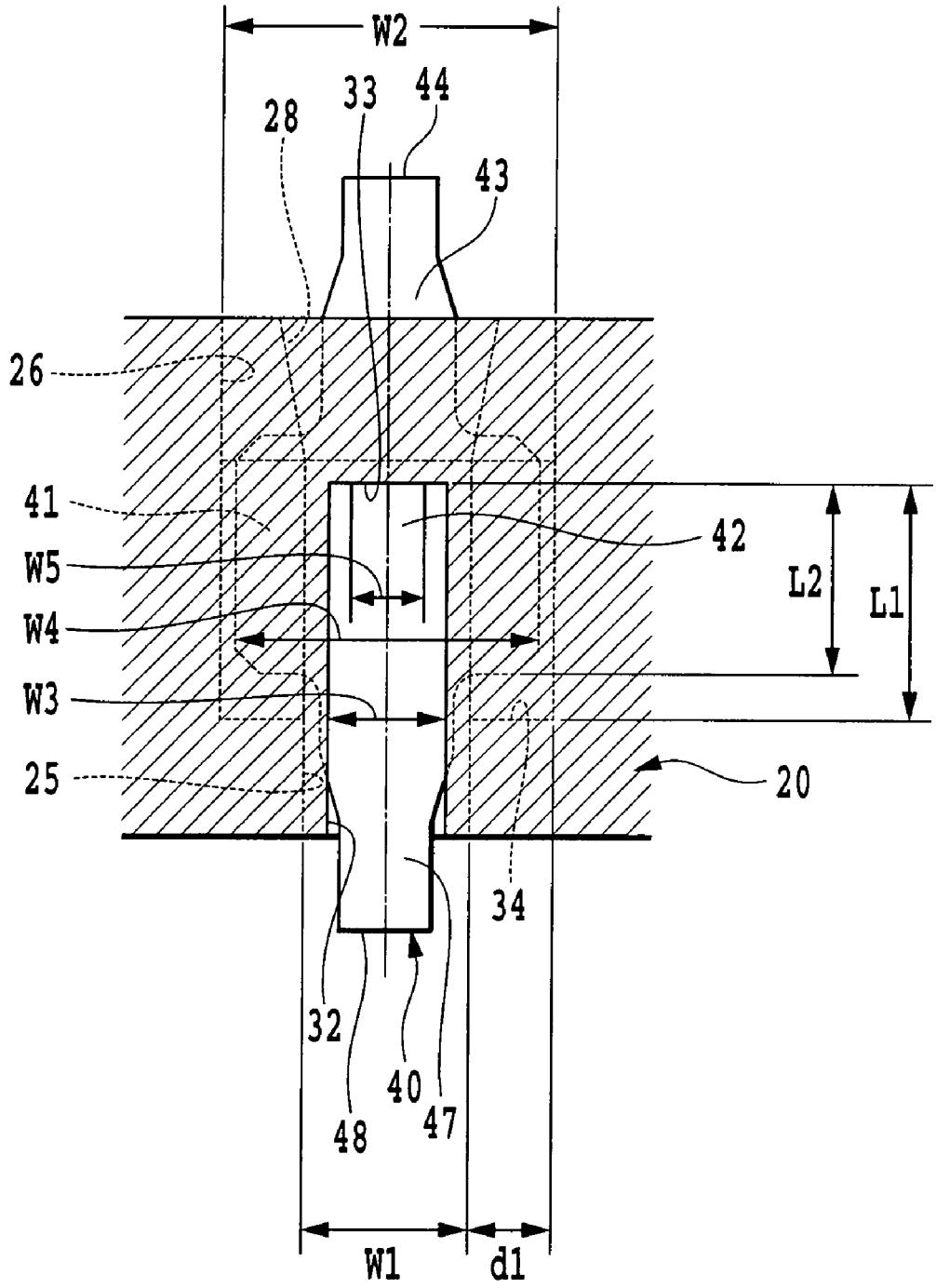
FIG. 11 is a schematic sectional view taken along line XI-XI in FIG. 10A.
Figure 12:
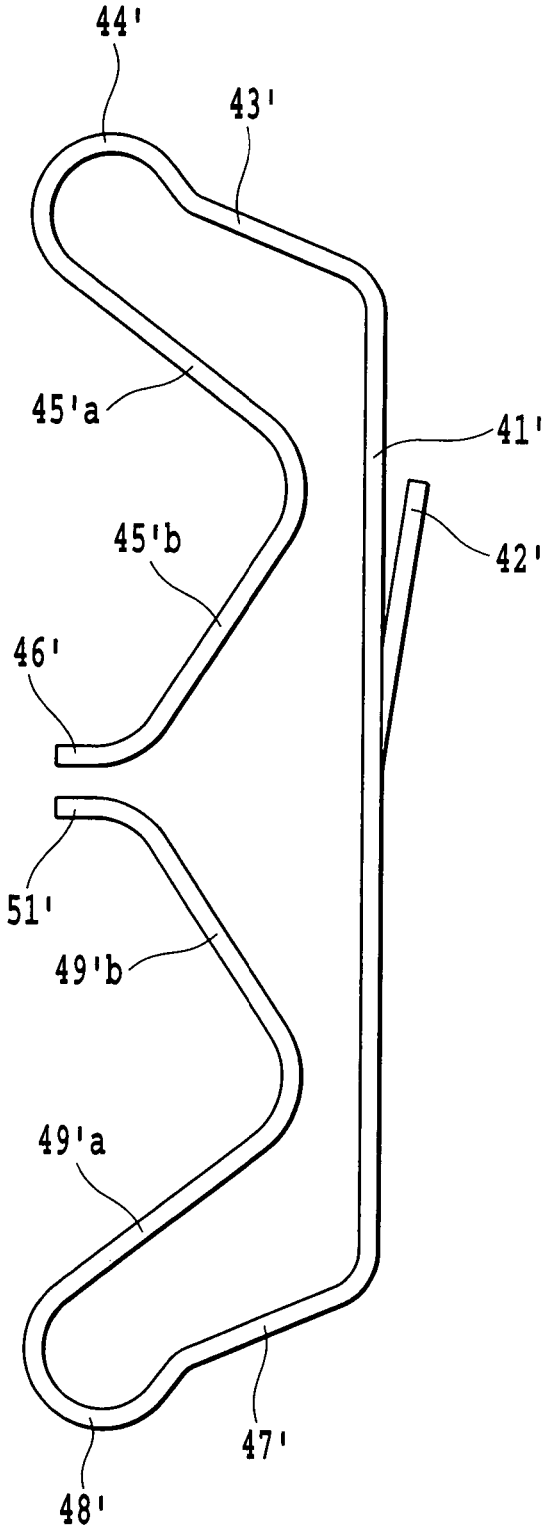
FIG. 12 is a front view of a contact in another embodiment according to the invention.
Figure 13:
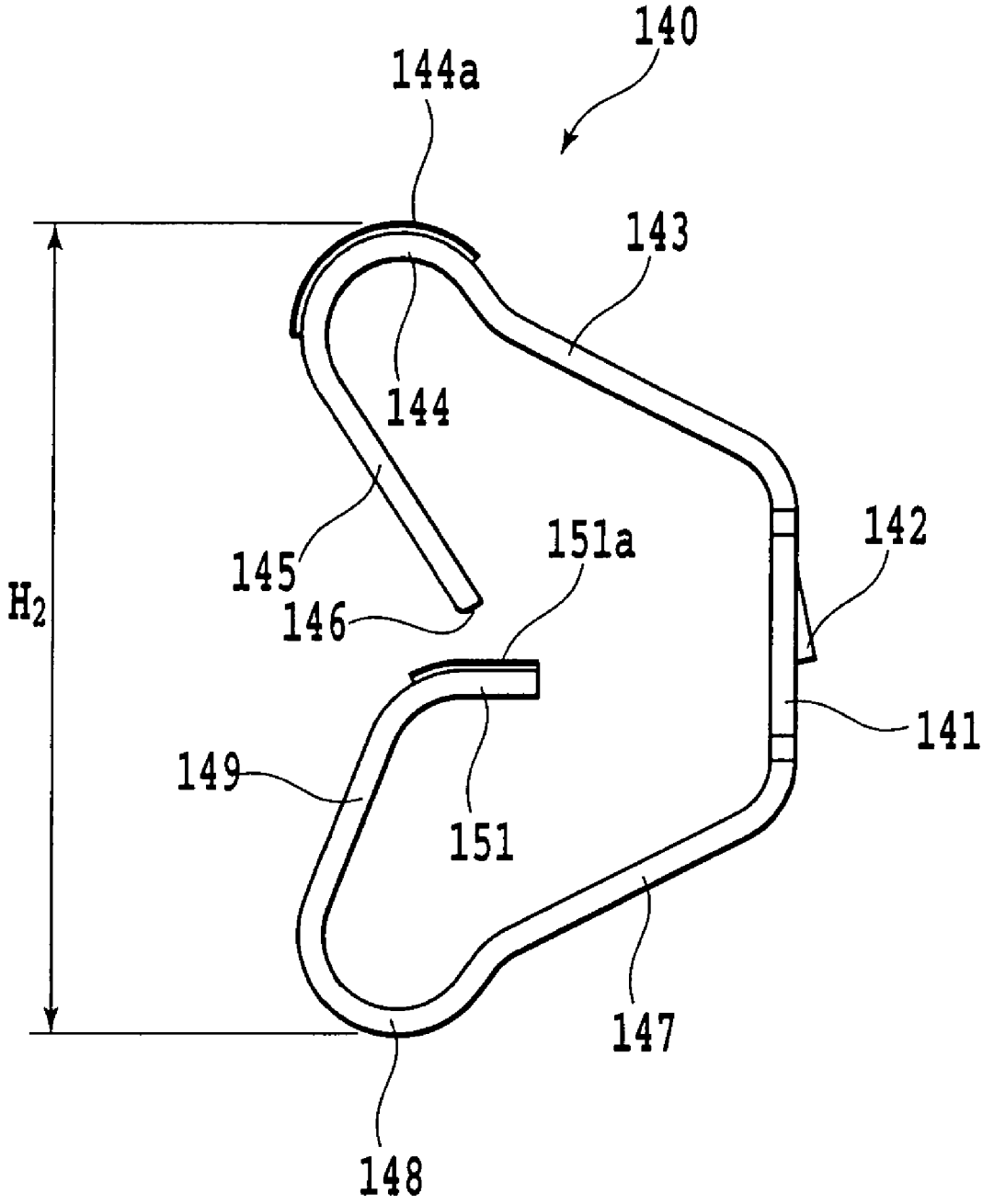
FIG. 13 is a front view of another contact according to the invention.
Figure 14:
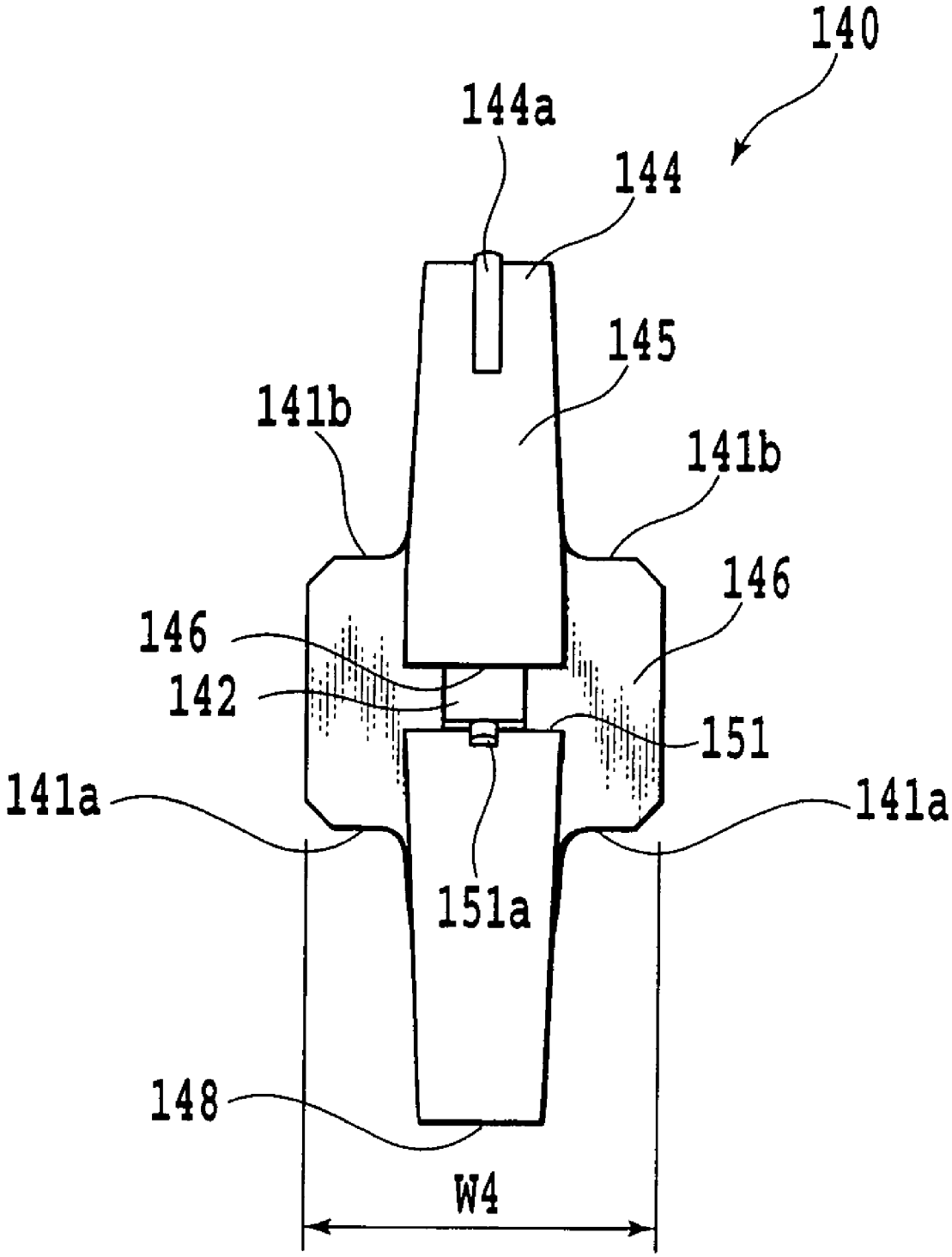
FIG. 14 is a left-side view of the contact shown in FIG. 13.
Figure 15:
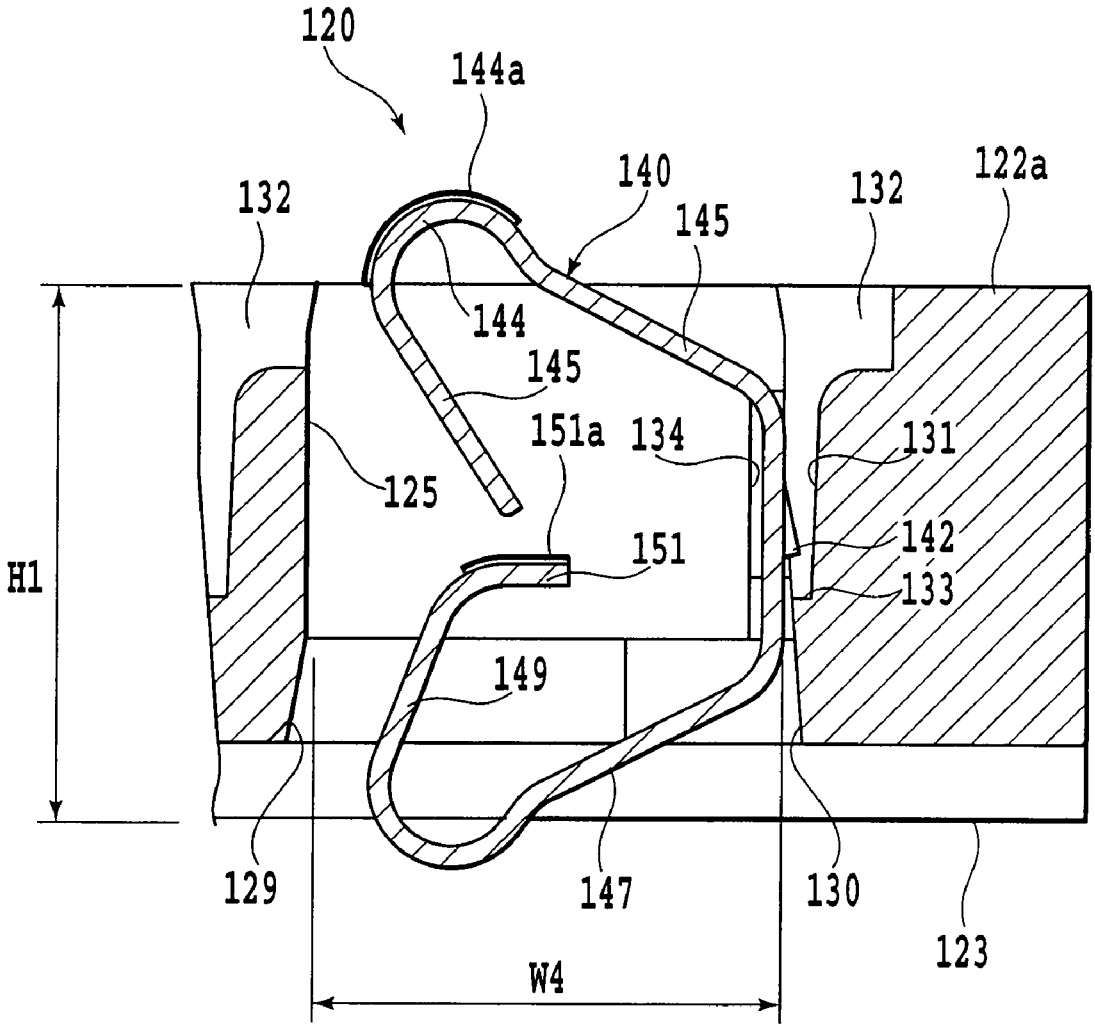
FIG. 15 is a schematic view showing a state that the contact shown in FIG. 13 is received in the contact-receiving chamber.
Figure 16:
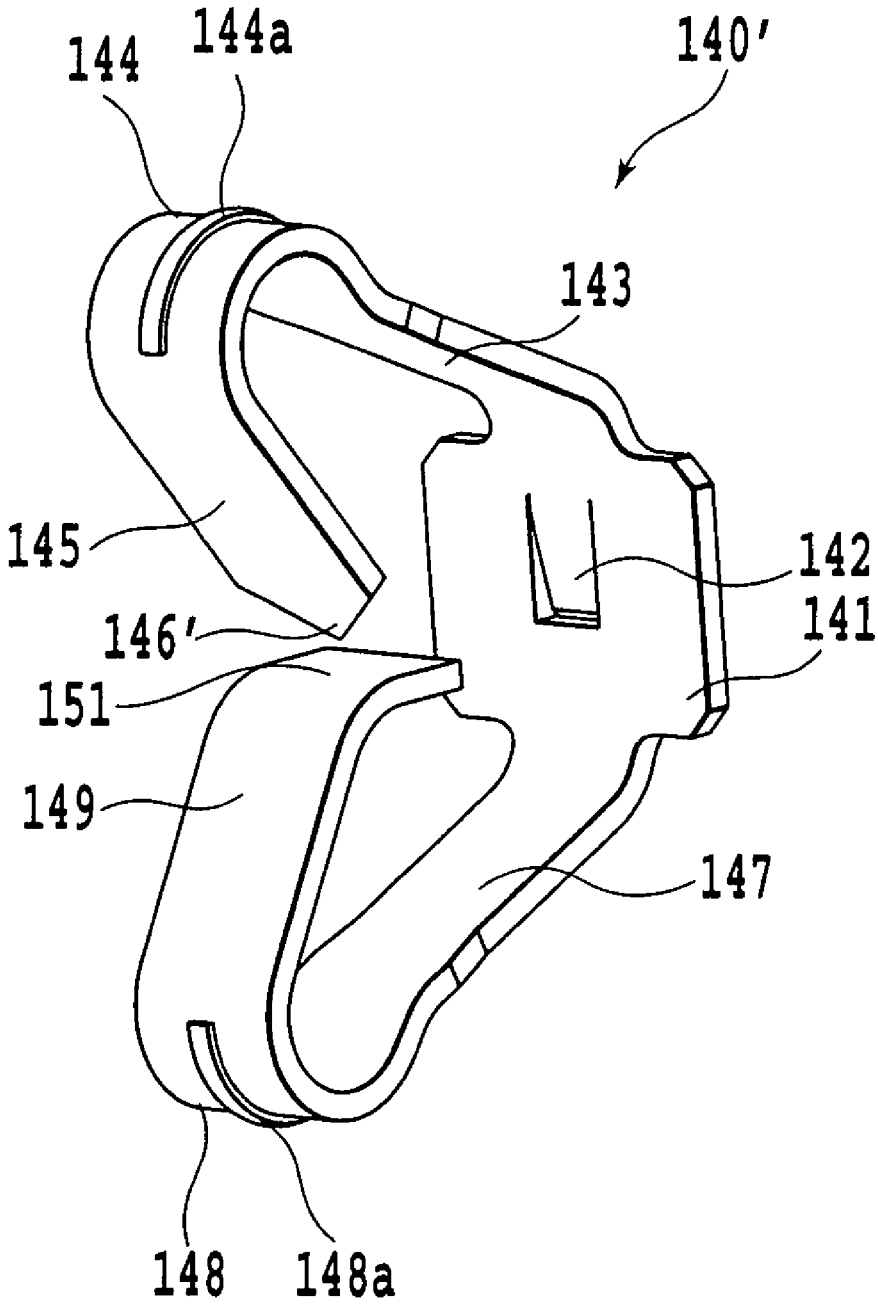
FIG. 16 is a modification to the contact according to the invention shown in FIG. 13.
Figure 17:
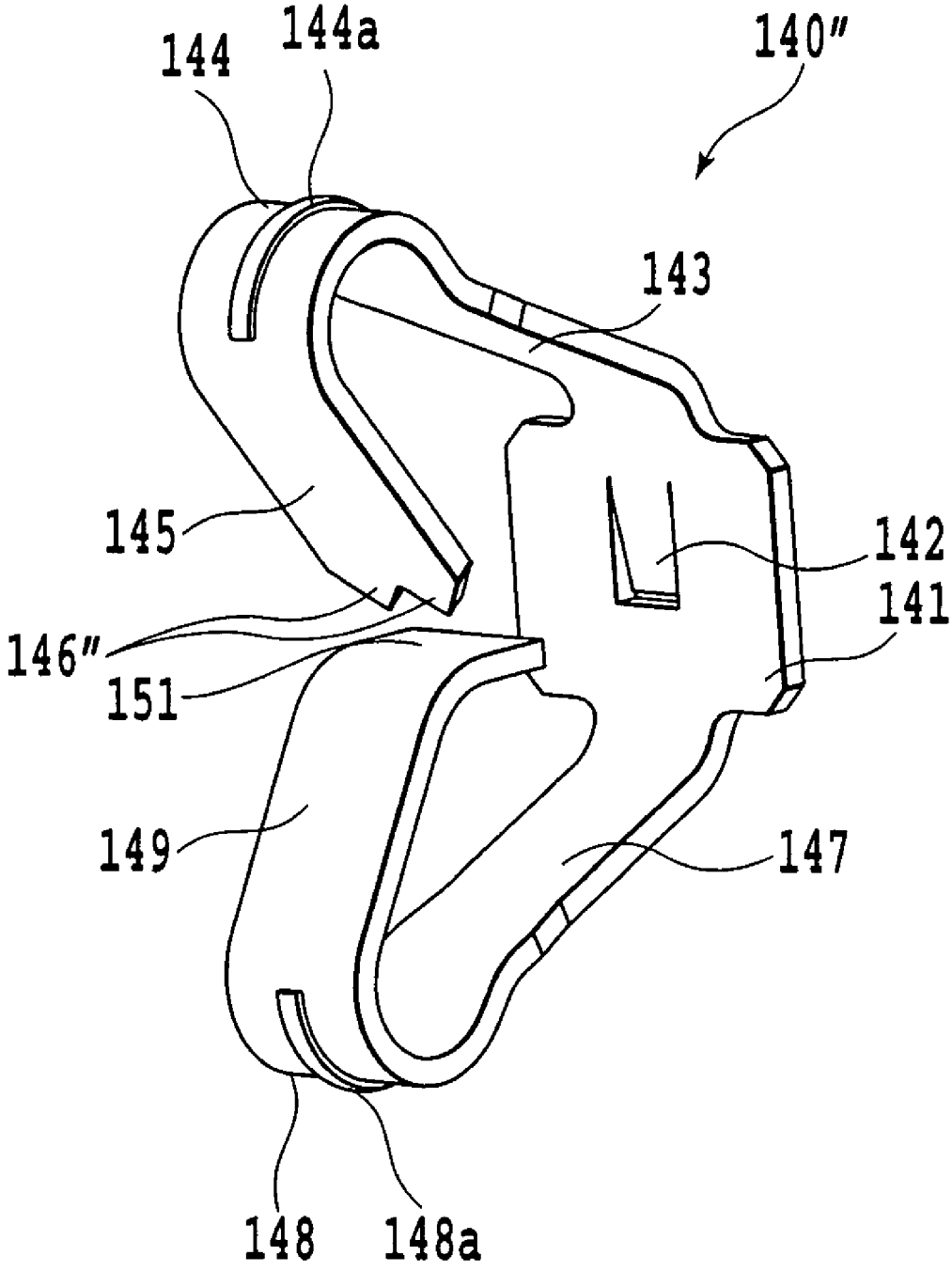
FIG. 17 is another modification to the contact according to the invention shown in FIG. 13.

FIG. 1 is a schematic exploded perspective view of an IC socket using contacts having two objects-to-contact, according to the present invention. FIG. 2 is a top view of a socket body of IC socket shown in FIG. 1. FIG. 3 is a schematic essential-part magnified sectional view taken along line III-III in FIG. 2. FIG. 4 is an essential-part magnified sectional view showing the state of contacts before mounting an IC package on the IC socket. FIG. 5 is an essential-part magnified sectional view showing the state of the contact where an IC package is mounted on the IC socket. FIG. 6 is a front view of a contact according to the invention. FIG. 7 is a left-side view of the FIG. 6 contact. FIG. 8 is a right-side view of the FIG. 6 contact. FIG. 9 is a schematic essential-part sectional view of a contact-receiving chamber of a socket body for receiving the contact in the FIG. 6. FIG. 10A is a schematic essential-part sectional view showing a contact fit in the contact-receiving chamber shown in FIG. 9. FIG. 10B is a schematic top view of the contact fit in the contact-receiving chamber shown in FIG. 9. FIG. 11 is a schematic sectional view taken along line XI-XI in FIG. 10A. FIG. 12 is a front view of a contact in another embodiment according to the invention. FIGS. 13 to 15 are a still another embodiment according to the present invention. FIG. 13 is a front view of another contact according to the invention. FIG. 14 is a left-side view of the contact shown in FIG. 13. FIG. 15 is a schematic view showing a state that the contact shown in FIG. 13 is received in the contact-receiving chamber. FIGS. 16 and 17 are modifications to the contact of the invention shown in FIGS. 13 to 15.

First Embodiment

As shown in FIG. 1, an IC socket 1 generally includes a socket body 20 and a press member 10. In the socket body 20, a plurality of contacts 40 are arranged to electrically connect between an IC package 80 and a printed-wiring board 60. The press member 10 is to push the IC package 80 placed on the IC socket 1 from above against the contacts 40. The press member 10 and the socket body 20 are fixed by fixing means 90, such as screws, directly on the printed-wiring board 60 or on a base member 70 through the printed-wiring board 60.

In an underside of the press member 10, a pusher (not shown) is formed to push the IC package 80. The press member 10 has preferably a heatsink 11 to dissipate heat, as shown in FIG. 1.

The socket body 20 is formed of an electrically insulating synthetic resin, e.g. liquid-crystal polymer, or polyether sulphone, nearly in a rectangular form as viewed from above as shown in FIGS. 2 and 3. The socket body 20 has, in its contour, an upper surface 21, a bottom surface 23 parallel with the upper surface 21, and four side surfaces orthogonal to and connecting between the surfaces 21, 23.

An IC-package mounting recess 22, which includes a bottom surface 22*a* generally in a square form as viewed from above, is formed nearly centrally in the upper surface 21 of the socket body 20. In this embodiment, the IC-package mounting recess 22 has four side surfaces orthogonal to the upper surface 21 of the socket body 20 and the bottom surface 22*a* parallel with the upper surface 21 of the socket body 20. The bottom surface 22*a* configures a mounting surface of an IC package 80. At four corners of the socket body 20, attaching holes 38 are formed in a manner penetrating through the socket body 20, to pass the fixing means 90 when fixing the socket body 20, for example, onto the printed-wiring board 60.

In the bottom surface 22*a* of the IC-package mounting recess 22, contact-receiving chambers 25 are arranged in a matrix form to receive therein a plurality of contacts 40 correspondingly to the external contacts of the IC package 80. The contact-receiving chambers 25 are formed through the socket body 20, from the bottom surface 22*a* serving as an IC-package mounting surface to the bottom surface 23 of the socket body 20. The contact-receiving chambers 25 are preferably formed such that a sectional line III-III, i.e. a longitudinal axial line thereof, inclines nearly 45 degrees relative to the side surfaces of the IC-package mounting recess 22, as shown in FIG. 2. This structure, though limited, may be accommodated to an IC package whose external contacts are narrower in pitch. In the contact-receiving chambers 25, contacts 40 are received one by one in the same direction, as shown in FIG. 3. The contact 40 and receiving it will be explained in details later. Incidentally, though not shown, a well-known positioning mechanism is preferably provided in the upper surface 21 of the socket body 20 in order to guide the IC package 80 into the IC-package mounting recess 22.

Using FIGS. 9 to 11, explanation is made on the structure of the contact-receiving chamber 25. As well shown in FIG. 10B, the contact-receiving chamber 25 is generally in a rectangular form that is long along the line III-III as viewed from above, to receive the contact 40 therein. Above the contact-receiving chamber 25, slant guide walls 27, 28, 29, 30 are formed to easily receive the contact.

In a lengthwise end of the contact-receiving chamber 25 (right end in FIGS. 9, 10A and 10B, in this embodiment), a pair of fitting grooves 26, 26 are formed extending orthogonal to the line III-III of the contact-receiving chamber 25. In the pair of fitting grooves 26, 26, the support member 41 of the contact 40, referred later, is loosely fit at its both sides. The fitting grooves 26, 26 in one pair has a spacing W2 at between the bottom surfaces thereof (i.e. (fitting groove depth d1×2)+ width W1 of the contact-receiving chamber 25). The spacing w2 is greater than a width W4 of the contact support member 41 (see FIG. 11). The fitting grooves 26, 26 in one pair are formed on the both sides of the chamber 25 at right end of the contact-receiving chamber 25, as shown in FIG. 10B. The fitting grooves 26 are open to above (toward the mounting surface 22*a*) and toward the contact-receiving chamber 25 but not open to the bottom surface 23 of the socket body 20. Namely, the fitting grooves 26 are each formed with a first restriction wall 34 preventing the contact 40 from being removed downward. Incidentally, the slant walls 27, 30 are provided to easily insert the support member 41 of the contact 40 in the fitting grooves 26.

In the right side surface of the contact-receiving chamber 25 (on the side that the pair of fitting grooves 26, 26 are provided), an engagement groove 31 is formed along the line III-III. In the engagement groove 31, loosely fit is an engagement claw 42 of the contact 40, referred later (see FIGS. 10A and 11). The engagement groove 31 has a width W3 smaller than the width W1 of the contact-receiving chamber 25 but greater than the width W5 of the engagement claw 41 of the contact 40 (see FIG. 11). The engagement groove 31 is open to below (toward the bottom surface 23 of the socket body 20) and toward the contact-receiving chamber 25 but not open to above (toward the mounting surface 22*a*). Namely, in the engagement groove 31, a second restriction wall 33 is formed to prevent the contact 40 from being removed upward. By abutting an upper end of the engagement claw 42 of the contact 40 against the second restriction wall 33, the contact 40 is not to be removed upward.

As shown in FIG. 11, the second restriction wall 33 is in a position above by a distance L1 relative to the first restriction wall 34. When the upper end of the engagement claw 42 of the contact 40 is in abutment against the second restriction wall 33, a lower end 41*a* of the support member 41 of the contact 40 is in a position above the first restriction wall 34. At this time, provided the distance of from the second restriction wall 33 to the lower end 41*a* of the support member 41 of the contact 40 is assumed L2, the contact 40 can move downward by an amount L1−L2.

The contact-receiving chambers 25, adjacent to each other in the direction of the axial line III-III, are communicated with each other through a communication groove 32 opening downward at below of the engagement groove 31. The communication groove 32 is not necessarily required.

The contact 40 is blanked as a plate member in a predetermined form, out of a conductive metallic thin plate, such as of beryllium copper (BeCu). By bending the plate member, it is formed in such a form as having two, upper and lower objects-to-contact as shown in FIGS. 6 to 8.

Referring to FIGS. 6 to 8, explanation is made on the concrete structure of the contact 40. The contact 40 has a support member 41 extending vertically and made broad in width and an engagement claw 42 formed rising obliquely upper rearwardly from the support member 41. The engagement claw 42 is elastically deformable, to deform when the contact 40 is received in the contact-receiving chamber 25. Incidentally, the engagement claw 42, though rises upward in the embodiment, may be formed rising downward (see the contact shown in FIGS. 13 to 15).

The contact 40 has a first spring portion 43 and a first curvature 44 as a first contact point. The first spring portion 43 extends upper frontward from the upper end 41*b* of the support member 41, thus inclining relative to the support member 41 (extending obliquely upper forwardly relative to the support member 41). The first curvature 44 as the first contact point is formed convex upward at the tip of the first spring portion 43. The first spring portion 43 and the first contact point 44 have a width smaller than the width of the support member 41. The contact 40 has further a second spring portion 45 and a second curvature 46 as a first touch portion. The second spring portion 45 is bent lower rearward and extending from the first contact point 44 (extending obliquely lower rearwardly relative to the first contact point 44). The second curvature 46 as the first touch portion is formed convex downward at the tip of the second spring portion 45. The second spring portion 45 has a width nearly equal to that of the first spring portion 43 and bent nearly in a V-form relative to the first spring portion 43 with the first contact point 44 provided as an apex. Meanwhile, the first touch portion 46 is formed somewhat broader in width than the second spring portion 45.

The contact 40 also has a third spring portion 47 and a third curvature 48 as a second contact point. The third spring portion 47 extends lower frontward from the lower end 41*a* of the support member 41, thus inclining relative to the support member 41 (extending obliquely lower forwardly relative to the support member 41). The third curvature 48 as the second contact point is formed convex downward at the tip of the third spring portion 47. The third spring portion 47, including the second contact point 48, extends in contrast with the first spring portion 43 including the first contact point 44 with respect to the support member 41. Accordingly, the third spring portion 47 has a width equal to that of the first spring portion 43 and smaller than the width of the support member 41. The contact 40 has a fourth spring portion 49 and a flat portion 51 as a second touch portion. The fourth spring portion 49 is bent back upper rearwardly and extending from the first contact point 48 (extending obliquely upper rearwardly relative to the second contact point 48). The flat portion 51 as the second touch portion is formed flatly (horizontal in the embodiment) at the tip of the fourth spring portion 49. The fourth spring portion 49 also extends from the second contact point 48 in contract with the second spring portion 45 with respect to the support member 41, similarly to the third spring portion 47. Meanwhile, the fourth spring portion 49 is bent generally in a V-form relative to the third spring portion 47 with the second contact point 48 provided as a summit. Furthermore, the second touch portion 51 is formed in a width somewhat greater than the fourth spring portion 49 but equal to the first touch portion 46.

In this embodiment, the first touch portion 46 is formed convex downward while the second touch portion 51 is formed flat. Conversely, the first touch portion 46 may be formed flat while the second touch portion 51 is convex upward. In brief, the first and second contact portions 46, 51 are preferably structured not to prevent the second and forth spring portions 45, 49 from elastically deform. Meanwhile, as shown in FIGS. 4 and 5, when the IC socket 1 is attached on the printed-circuit board 60 and when the IC package 80 is further mounted, the first and second contact portions 46, 51 are placed in mutual contact to form a short signal path. Otherwise, the first touch portion 46 and the second touch portion 51 may be made in a contact state from the beginning. In brief, the first to fourth spring portions 43, 45, 47 and 49 of the contact 40 are satisfactorily to act as a spring in the state the IC package 80 is mounted.

The both sides of the broad-width support member 41 of the contact 40 (portions projecting widthwise from the first and third spring portions 43, 47 formed in the upper and lower of the support member 41) is received in the pair of fitting grooves 26 of the socket body 20, thus being held nearly vertical relative to the socket body 20. When receiving the support member 41 in the fitting grooves 26, the engagement claw 42 is fit simultaneously in the engagement groove 31. In this manner, the contact 40 is held to be able to move vertically within the socket body 20 in the state as shown in FIGS. 10 and 11. Incidentally, the engagement claw 42 of the contact 40 is preferably made rounded at its tip in order to assist the contact 40 to move vertically.

The contact 40 has a distance H2 between the first and second contact points 44, 48 (a height of the contact 40), that is greater than the height H1 of the contact-receiving chamber 25. Accordingly, when the contact 40 is received in the contact-receiving chamber 25 of the socket body 20, the first contact point 44 of the contact 40 projects above the mounting surface 22*a* of the socket body 20 while the second contact point 48 projects below the bottom surface 23 of the socket body 20, as clearly shown in FIG. 10A.

Second Embodiment

FIG. 12 shows another embodiment as a modification to the contact according to the invention.

By providing the mounted IC package 80 with external terminals 81 at a smaller pitch, the contact-receiving chamber 25 is made long vertically, i.e. comparatively increased in height H1 relative to the depth S1 of the contact-receiving chamber 25 (see FIG. 9). In case the contact 40 is made long longitudinally correspondingly to the contact-receiving chamber 25 long longitudinally, the second and fourth spring portions 45, 49 are arranged in a nearly straight form through the respective touch portions 46, 51. This results in the second and fourth spring portions 45, 49 becoming less elastically deformable. The present embodiment provides a contact 40' suited for a contact-receiving chamber vertically long as in the above.

The contact 40' of this embodiment is generally identical in structure as compared to the contact 40 of the FIG. 6 embodiment, except for the substantial difference in the second and fourth spring portions 45, 49 of the contact 40.

The second spring portion, in this embodiment, includes a portion 45'*a* bent and extending lower rearwardly from a first contact point 44' (extending obliquely lower downwardly relative to the first contact point 44') and a portion 45'*b* bent and extending obliquely lower forwardly from the portion 45'*a*. Accordingly, the second spring portion of the contact 40' is formed in a V-form directed horizontally, as shown in FIG. 11. The second spring portion, of the contact 40' in this embodiment, includes a first touch portion 46' at the tip of the portion 45'*b*. Similarly, the fourth spring portion includes a portion 49'*a* bent and extending upper rearwardly from a second contact point 48' (extending obliquely upper rearwardly relative to the second contact point 48') and a portion 49'*b* bent and extending upper forwardly from the portion 49'*a*. Accordingly, the fourth spring portion of the contact 40' is also formed in a V-form directed horizontally. Meanwhile, the fourth spring portion in this embodiment includes a second touch portion 51' at the tip of the portion 49'*b*.

By thus forming the contact 40', the second and fourth spring portions are prevented from becoming less elastically deformable with a result that the contact can maintain high springiness.

Referring to FIGS. 4 and 5, explanation is now made on the operation of the contact 40 in the case that an IC socket 1 having a contact 40 structured as above is attached on a printed-wiring board 60 and then an IC package is mounted thereon.

In this embodiment, in case the IC socket 1 is attached on the printed-wiring board 60, the third spring portion 47 of the contact 40 elastically deforms clockwise about a lower end 41*a* of the support member 41, as shown in FIG. 4. Due to this, the second touch portion 51 is placed in contact with the first touch portion 46. At this time, the second contact point 48 is in contact with the external contact of the printed-wiring board 60.

In this state, the IC package 80 is guided onto the mounting surface 22*a* of the socket body 20 so that the external contacts 81 of the IC package 80 are placed in contact with the first contact portions 44 of the corresponding contacts 40. Then, the IC package 80 is pushed down onto the mounting surface 22*a* through the press member 10. Due to this, the first spring portions 43 of the contacts 40 are first elastically deformed counterclockwise in FIG. 4 about the upper ends 41*b* of the support members 41.

Then, the IC package 80 is pushed down into a state being abutted against the mounting surface 22*a*, as shown in FIG. 5. At this time, the second spring portions 45 of the contacts 40 each elastically deforms counterclockwise about the first contact point 44. Meanwhile, the third spring portion 47 also elastically deforms clockwise in a somewhat degree from the FIG. 4 state while the fourth spring portion 49 elastically deforms clockwise about the second contact point 48. This causes the support member 41 of the contact 40 to move down as shown in FIG. 5. Namely, in the contacts 40 of the invention, all the spring portions 43, 45, 47, 49 can be elastically deformed by moving the contacts 40 themselves within the respective contact-receiving chambers 25 of the socket body 20.

In this manner, when the IC package 80 is mounted perfectly on the mounting surface 22*a* of the socket body 20, the contact 40 exhibits well springiness through the elastic deformation of all the first to fourth spring portions 43, 45, 47, 49. Due to this, desired contact pressure is to be obtained in the electrical connections between the first contact point 44 of the contact 40 and the external contact 81 of the IC package 80 and between the second contact point 48 and the external contact of the printed-wiring board 60. On the other hand, because of forming a short signal line by a contact between the first touch portion 46 and the second touch portion 51 of the contact 40, the contact 40 of the invention is compatible with exchanging high-frequency signals.

Third Embodiment

FIGS. 13 to 15 show an embodiment of an IC socket using still another contact according to the invention.

A contact 140 in the embodiment is basically not different from the contact 40 of the first embodiment. Namely, the contact 140 in the embodiment is structurally different in respect of the following three points from the contact 40 of the first embodiment but generally the same in the other structural points.

(1) Upwardly convex ridge portions 144*a*, 151*a* are formed respectively as a first contact point and a second touch portion in a first curvature 144 and a flat portion 151 extending at the tip of a fourth spring portion 149.

(2) The first touch portion 146 is not formed curved, i.e. the first touch portion 146 is a tip of the second spring portion 145 extending obliquely lower rearwardly from the first curvature 144.

(3) The support 141 has an engagement claw 142 rising obliquely lower rearwardly.

By providing the above three different points in the contact 140 of this embodiment, the contact-receiving chamber 125 formed in the socket body 120 is different only in that it is formed nearly vertically inverted, thus being substantially the same in structure. Hence, the receiving chamber 125 of the socket body 120 and the contact 140 are omitted to explain. Incidentally, in the present embodiment, its constituent elements are denoted with those added 100 to the numbers used in the first embodiment.

The present embodiment, structured as above, has the following advantages over the first embodiment.

(i) By providing the above differences (1), (2) in this embodiment, contacting is electrically provided nearly as point contact at between the IC package mounted on the IC socket and the first contact point 144*a* and between the first touch portion 146 and the second touch portion 151*a*. By virtue of such point contact, electrically stably contacting is obtained without the intervention of an insulator, such as dust.

(ii) Meanwhile, by the above difference (3) and the socket-receiving chamber 125 structurally formed vertically inverted, the contact 140 can be inserted from below into the socket-receiving chamber 125 and assembled into an IC socket 120. This makes it easy to receive a multiplicity of contacts in the contact-receiving chamber of the IC socket.

In the present embodiment, the first contact point 144*a* and the second touch portion 151*a* were each formed as a ridge portion convexed upwardly in order to obtain point contact. However, this is not limitative. For example, a first touch portion 146' continuing from the second spring portion 145 may be formed convexed downwardly as shown in FIG. 16 with the second touch portion kept flatly similarly to the first embodiment. This structure also provides a point, electrical contact between the first touch portion 146' and the second touch portion 151. Incidentally, although the first touch portion 146' in this embodiment is formed triangular in form and sharpened at its tip at a predetermined angle, the tip may be formed arcuate in form, i.e. rounded. Furthermore, as shown in FIG. 17, the first touch portion 146" may be in a two-point abutment form having two downward convexes.

Meanwhile, as shown in FIGS. 16 and 17, a third curvature 148 may be formed with a downwardly convexed ridge portion 148 as a second contact point. This provides point, electrical contact between the contact and the printed-wiring board.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A contact comprising:

a support member extending vertically and broad in width;

a first spring portion extending obliquely upper forwardly from an upper end of the support member and having, at an apex, a first contact point which contacts with an integrated circuit package;

a second spring portion bent from the first contact point, to extend obliquely lower rearwardly and having a first touch portion at a tip thereof;

a third spring portion extending obliquely lower forwardly from a lower end of the support member and having, at an apex thereof, a second contact point which contacts with a printed-wiring board, thus being in contrast with the first spring portion with respect to the support member; and a fourth spring portion bent from the second contact point and extending obliquely upper rearwardly, and having at a tip a second touch portion for contacting with the first touch portion;

wherein the second touch portion at the tip of the fourth spring portion is a flat portion and bent downward at an angle relative to the fourth spring portion.

2. A contact according to claim 1, wherein the second spring portion is bent from the first contact point and extending obliquely lower rearwardly, and further bent obliquely lower forwardly to have a first touch portion at a tip thereof.

3. A contact according to claim 1, wherein an engagement claw, for preventing removal, is formed rising obliquely rearwardly in the support member.

4. A contact according to claim 1, wherein one of the first and second touch portions is formed flat while the other is formed curved.

5. A contact according to claim 1, wherein the flat portion of the second touch portion is formed with a ridge portion convexed upwardly; and the ridge portion contacts with the first touch portion.

6. A contact according to claim 1, wherein the fourth spring portion is bent from the second contact point and extending obliquely upper rearwardly, and further bent obilquely upper forwardly to have a second touch portion at a tip thereof.

7. A contact according to claim 2, wherein the fourth spring portion is bent from the second contact point and extending obliquely upper rearwardly, and further bent obliquely upper forwardly to have a second touch portion at a tip thereof.

8. An IC socket comprising:

a socket body having an IC-package mounting recess and a plurality of contact-receiving chambers formed in a bottom of the IC-package mounting recess correspondingly to external contacts of an IC package;

a plurality of contacts respectively received in the plurality of contact-receiving chambers;

a press member that pushes an IC package, placed in the IC-package mounting recess, onto contacts received in the contact-receiving chambers;

wherein the contact having a support member extending vertically and broad in width;

a first spring portion extending obliquely upper forwardly from an upper end of the support member and having, at an apex, a first contact point where to contact with an integrated circuit package;

a second spring portion bent from the first contact point and extending obliquely lower rearwardly, and having a first touch portion at a tip thereof;

a third spring portion extending obliquely lower forwardly from a lower end of the support member and having, at an apex thereof, a second contact point where to contact with a printed-wiring board, thus being in contrast with the first spring portion with respect to the support member; and a fourth spring portion bent from the second contact point and extending upper rearwardly, and having at a tip a second touch portion for contacting with the first touch portion;

wherein the second touch portion at the tip of the fourth spring portion is a flat portion and bent downward at an angle relative to the fourth spring portion.

9. An IC socket according to claim 8, wherein the second spring portion is bent from the first contact point and extending obliquely lower rearwardly, and further bent obliquely lower forwardly to have a first touch portion at a tip thereof.

10. An IC socket according to claim 8, wherein an engagement claw, for preventing removal, is formed rising obliquely rearwardly in the support member.

11. An IC socket according to claim 8, wherein the contact is held to be able to move vertically within the socket body.

12. The IC socket of claim 8, further comprising:

a contact receiving chamber, having slanted guide walls, for receiving the contact.

13. An IC socket according to claim 8, wherein the fourth spring portion is bent from the second contact point and extending obliquely upper rearwardly, and further bent obliquely upper forwardly to have a second touch portion at a tip thereof.

14. An IC socket according to claim 10, wherein the contact-receiving chamber is formed through the socket body and has a pair of fitting grooves where the contact is fit at both sides of the support member broad in width and an engagement groove to receive the engagement claw of the contact.

15. An IC socket according to claim 14, wherein the filling groove is formed with a first restriction wall while the engagement groove is formed with a second restriction wall, the first and second restriction walls have a distance greater than a distance of between an upper end of the engagement claw and a lower end of the support member of the contact.

16. The IC socket of claim 10, further comprising:

a contact receiving chamber, having slanted guide walls, for receiving the contact and configured to engage the engagement claw.

17. An IC socket according to claim 9, wherein the fourth spring portion is bent from the second contact point and extending obliquely upper rearwardly, and further bent obliquely upper forwardly to have a second touch portion at a tip thereof.

18. A contact comprising:

a support member extending vertically and broad in width;

a first spring portion extending obliquely upper forwardly from an upper end of the support member and having, at an apex, a first contact point which contacts with an integrated circuit package;

a second spring portion bent from the first contact point, to extend obliquely lower rearwardly and having a first touch portion at a tip thereof;

a third spring portion extending obliquely lower forwardly from a lower end of the support member and having, at an apex thereof, a second contact point which contacts with a printed-wiring board, thus being in contrast with the first spring portion with respect to the support member; and a fourth spring portion bent from the second contact point and extending obliquely upper rearwardly, and having at a tip a second touch portion for contacting with the first touch portion;

wherein the second touch portion is bent downward at an angle relative to the fourth spring portion and formed with a ridge portion convexed upwardly; and wherein the ridge portion contacts with the first touch portion.

19. An IC socket comprising:

a socket body having an IC-package mounting recess and a plurality of contact-receiving chambers formed in a bottom of the IC-package mounting recess correspondingly to external contacts of an IC package;

a plurality of contacts respectively received in the plurality of contact-receiving chambers;

a press member that pushes an IC package, placed in the IC-package mounting recess, onto contacts received in the contact-receiving chambers;

wherein the contact having a support member extending vertically and broad in width;

a first spring portion extending obliquely upper forwardly from an upper end of the support member and having, at an apex, a first contact point where to contact with an integrated circuit package;

a second spring portion bent from the first contact point and extending obliquely lower rearwardly, and having a first touch portion at a tip thereof;

a third spring portion extending obliquely lower forwardly from a lower end of the support member and having, at an apex thereof, a second contact point where to contact with a printed-wiring board, thus being in contrast with the first spring portion with respect to the support member; and a fourth spring portion bent from the second contact point and extending upper rearwardly, and having at a tip a second touch portion for contacting with the first touch portion;

wherein the second touch portion is bent downward at an angle relative to the fourth spring portion and formed with a ridge portion convexed upwardly; and wherein the ridge portion contacts with the first touch portion.

* * * * *

UNITED STATES PATENT AND TRADEMARK OFFICE

CERTIFICATE OF CORRECTION

PATENT NO. : 7,621,755 B2
APPLICATION NO. : 11/808672
DATED : November 24, 2009
INVENTOR(S) : Masaaki Kubo et al.

It is certified that error appears in the above-identified patent and that said Letters Patent is hereby corrected as shown below:

Claim 6, column 10, line 40, "obilquely" should read --obliquely--.

Claim 15, column 11, line 33, "filling" should read --fitting--.

Signed and Sealed this

Sixteenth Day of March, 2010

David J. Kappos

David J. Kappos
*Director of the United States Patent and Trademark Office*